US009661914B2

(12) United States Patent
Gallup

(10) Patent No.: US 9,661,914 B2
(45) Date of Patent: May 30, 2017

(54) PORTABLE LIGHTING ASSEMBLY

(71) Applicant: Rescue Leaders LLC, Paterson, NJ (US)

(72) Inventor: Matthew D. Gallup, Paterson, NJ (US)

(73) Assignee: Rescue Leaders LLC, Wayne, NJ (US)

( * ) Notice: Subject to any disclaimer, the term of this patent is extended or adjusted under 35 U.S.C. 154(b) by 0 days.

(21) Appl. No.: 15/017,728

(22) Filed: Feb. 8, 2016

(65) Prior Publication Data

US 2016/0223150 A1 Aug. 4, 2016

Related U.S. Application Data

(63) Continuation-in-part of application No. 14/159,118, filed on Jan. 20, 2014, now Pat. No. 9,254,011.

(60) Provisional application No. 61/885,655, filed on Oct. 2, 2013.

(51) Int. Cl.

| | |
|---|---|
| ***A45F 5/02*** | (2006.01) |
| ***F21V 33/00*** | (2006.01) |
| ***F21L 4/00*** | (2006.01) |

(52) U.S. Cl.

CPC ..... *A45F 5/021* (2013.01); *F21L 4/00* (2013.01); *F21V 33/0008* (2013.01); *F21V 33/0076* (2013.01)

(58) Field of Classification Search

CPC ..... A45F 5/021; F21L 4/00; F21V 33/0008; F21V 33/0076

See application file for complete search history.

(56) References Cited

U.S. PATENT DOCUMENTS

| | | | | |
|---|---|---|---|---|
| 2,597,073 | A * | 5/1952 | Cunningham | F21L 15/06 307/71 |
| 5,630,382 | A | 5/1997 | Barbera | |
| 6,095,657 | A | 8/2000 | Kent | |
| 6,106,130 | A | 8/2000 | Harding | |
| 9,254,011 | B2 | 2/2016 | Gallup | |
| 2013/0128556 | A1 | 5/2013 | Brauser | |

* cited by examiner

*Primary Examiner* — David V Bruce
(74) *Attorney, Agent, or Firm* — John H. Choi

(57) ABSTRACT

A portable fighting assembly may include a housing comprising a power source compartment that opens to a first end, wherein a power source may be enclosed by a power source compartment closure. A cover may enclose the power source and power source compartment closure. The cover may removably attach to the first end of the housing. A light may attach to a second end of the housing. The housing and cover may attach to a base which may attach to a first end of a strap by a fastener. A second and a third fastener may be attached to the strap to removably hold the strap in position while the strap may surround an object such as a utility belt, pant belt or the like. In certain embodiments, instead of a strap, the base may have wings that removably attach to each other.

20 Claims, 8 Drawing Sheets

FIG. 6
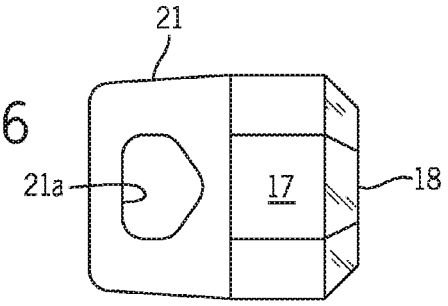
FIG. 7
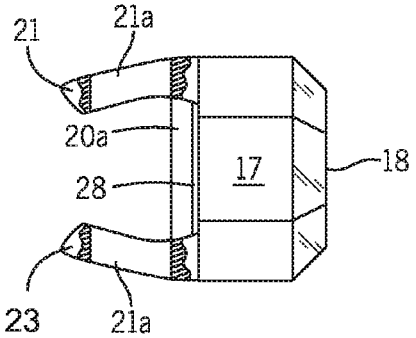
FIG. 8
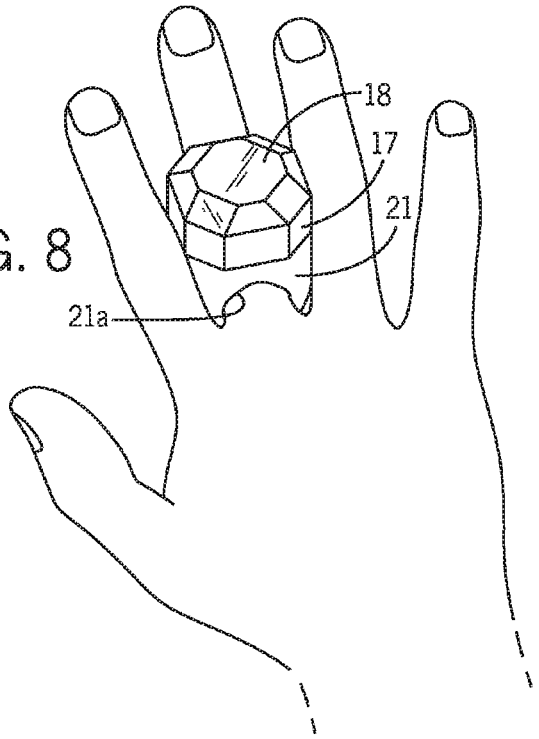
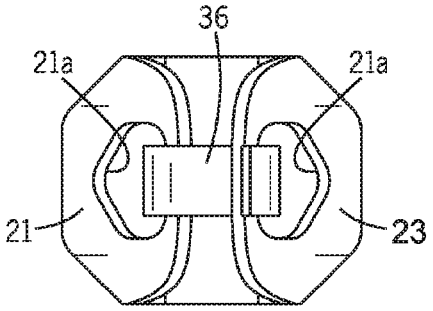
FIG. 9

PORTABLE LIGHTING ASSEMBLY

CROSS-REFERENCE TO RELATED APPLICATIONS

This application is a continuation-in-part of and claims the benefit of U.S. application Ser. No. 14/159,118, filed on Jan. 20, 2014, which claims the benefit of U.S. Provisional Application No. 61/885,655, filed Oct. 2, 2013, the contents of which are incorporated by reference.

BACKGROUND OF THE INVENTION

The present invention relates to lighting assemblies, and in particular to a portable lighting assembly capable of attaching to persons, objects, clothing, clothing accessories and the like.

Often times light is required in situations of emergency. For example, light is required in environments where vision is impaired such as when there is lack of sunlight or artificial light and where there is fog or smoke. In other examples, light might be required to warn of any hazards or identify emergency workers.

Currently, there is no light or lighting assembly which could be universally used in a variety of ways in different emergency situations. As can be seen, there is a need for a portable lighting assembly that has the ability to attach to persons, objects, clothing, clothing accessories and the like.

SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

The lighting assembly of the present invention provides a universal lighting assembly that could be used in a variety of applications. The lighting assembly could be used to assist in vision, warn of any hazards, identify the emergency workers, and identify and categorize the injured. The lighting assembly could be attached to persons, objects, clothing, clothing accessories and the like.

Broadly, the present invention provides a portable lighting assembly that may include a housing comprising a power source compartment that opens to a first end, wherein a power source may be enclosed by a power source compartment closure. A cover may enclose the power source and power source compartment closure. The cover may removably attach to the first end of the housing. A light may attach to a second end of the housing.

The housing and cover may attach to a base which may attach to a first end of a strap by a fastener. A second and a third fastener may be attached to the strap to removably hold the strap in position while the strap may surround an object such as a utility belt, pant belt or the like. In certain embodiments, instead of a strap, the base may have wings that removably attach to each other.

In one aspect of the present invention, a portable lighting assembly comprises: a housing comprising a power source compartment open to a first end, wherein a power source is enclosed by a power source compartment closure; a cover enclosing the power source and power source compartment closure, wherein the cover removably attaches to the first end of the housing; and a light attached to a second end of the housing, wherein the light connects to the power source.

In another aspect of the present invention, a portable lighting assembly comprising: a housing comprising a power source compartment, wherein a power source is enclosed; and a light attached to the housing, wherein the light connects to the power source.

BRIEF DESCRIPTION OF THE DRAWINGS

The foregoing summary, as well as the following detailed description of presently preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

FIG. 6 is a side elevation view of the light unit of FIG. 1;

FIG. 7 is a top, partial cross sectional view of the light unit of FIG. 6;

FIG. 8 is a perspective view of the light unit of FIG. 6 in an alternative use;

FIG. 9 is a rear view of the light unit of FIG. 8 in a second embodiment of a lighting assembly of the present invention;

Figure 1:
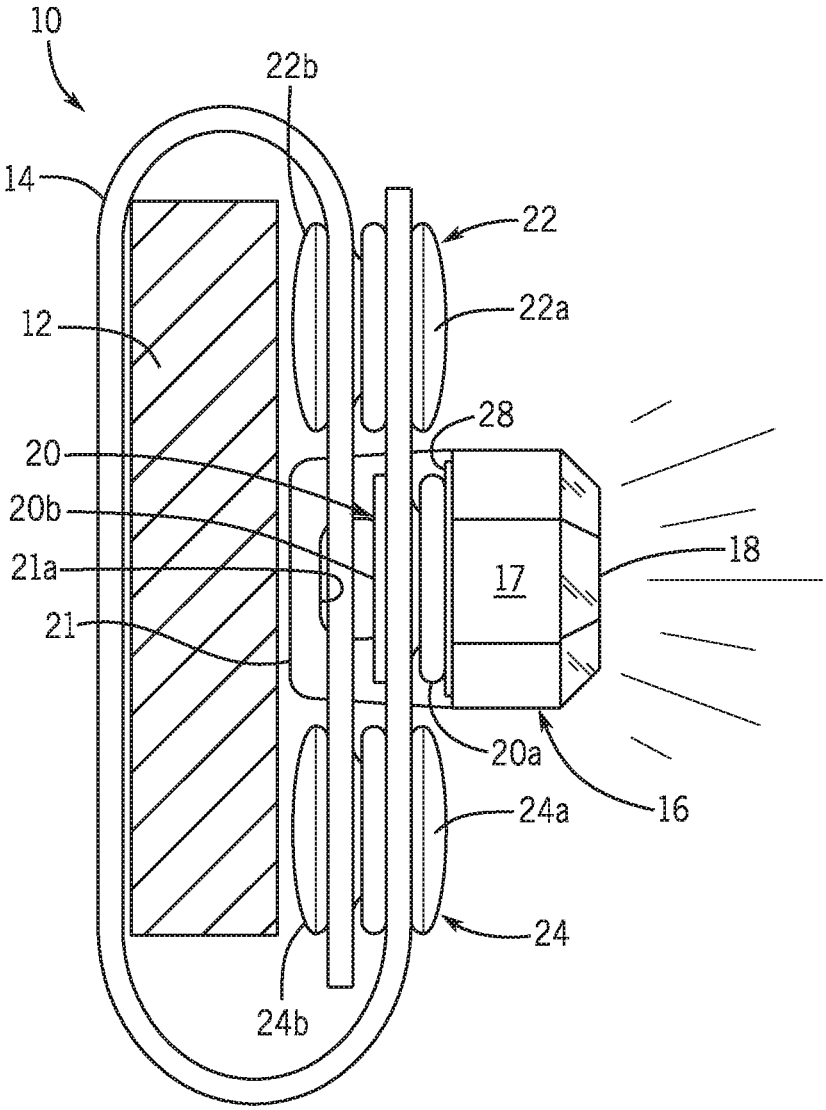
FIG. 1 is a side elevation view of a first embodiment of a light unit of the present invention in use with an embodiment of a retaining member of the present invention to form a first embodiment of a lighting assembly of the present invention.
Figure 2:
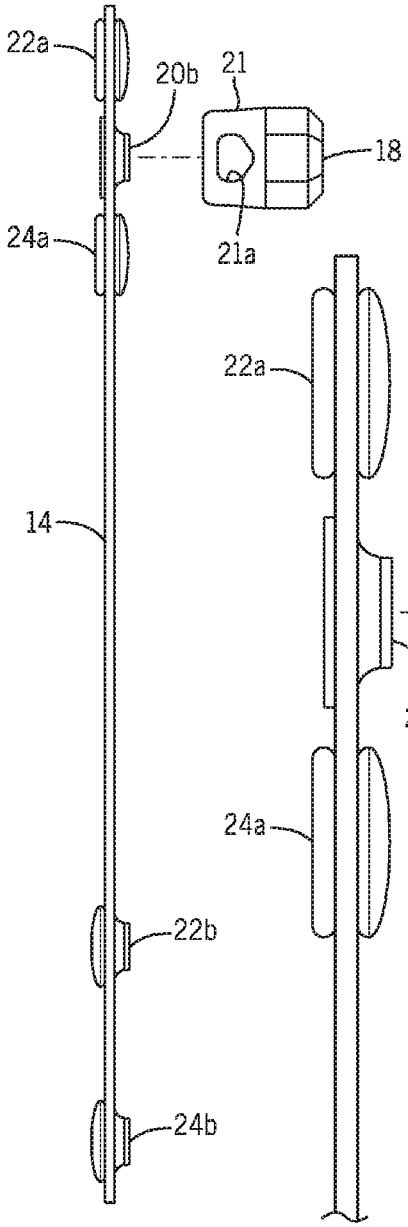
FIG. 2 is a side elevation view of the lighting assembly of FIG. 1 with the light unit detached from the retaining member.
Figure 3:
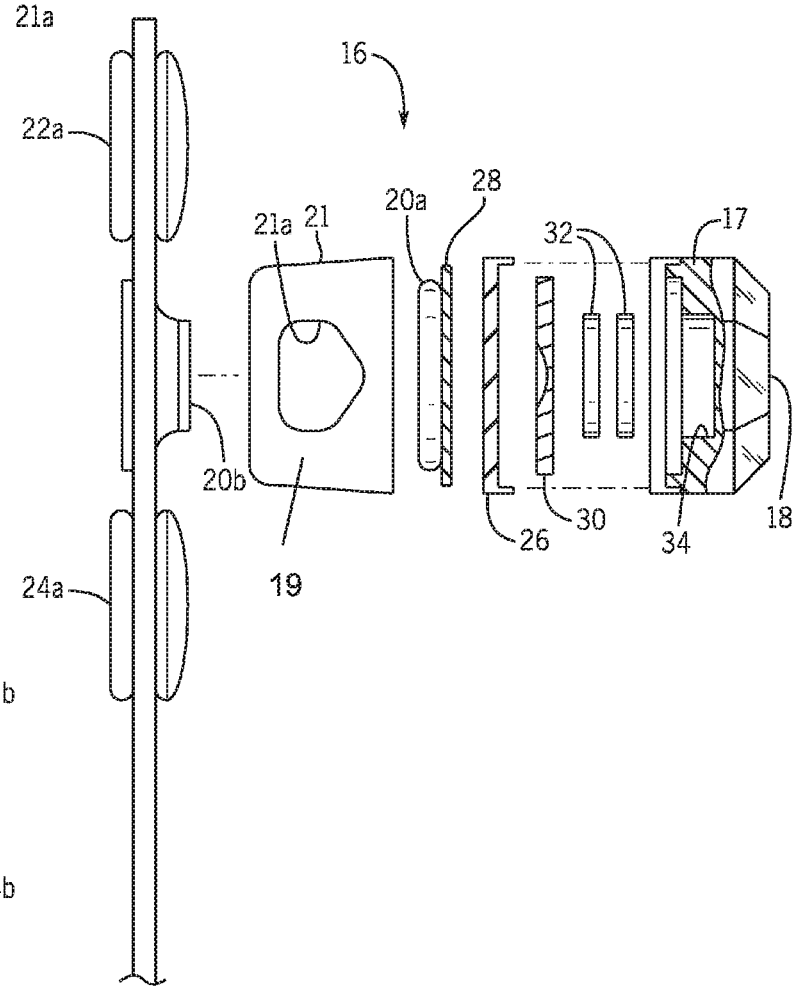
FIG. 3 is a detailed exploded side elevation view of the lighting assembly of FIG. 2.
Figure 4:
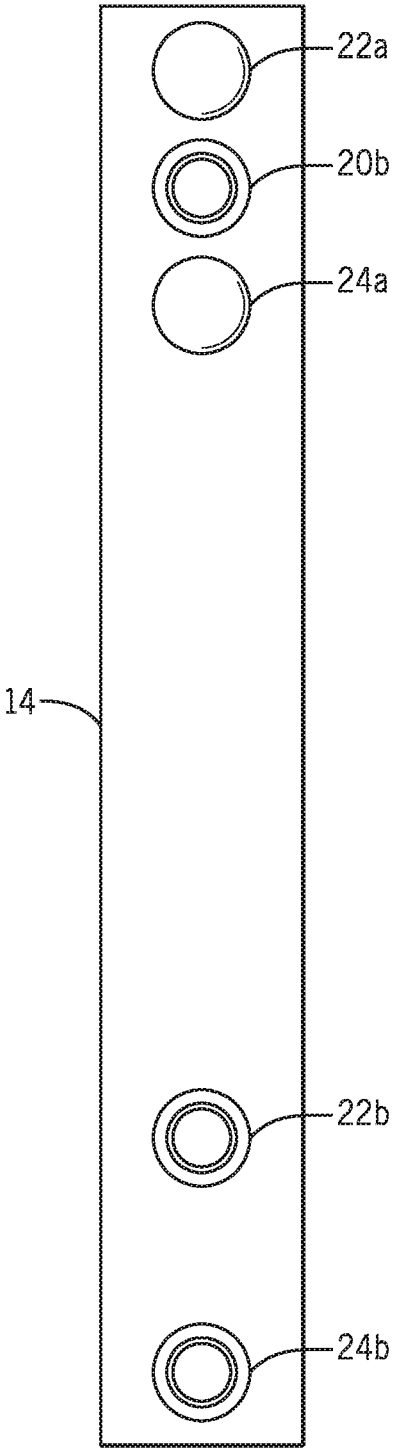
FIG. 4 is a front elevation view of the retaining member of the present invention.
Figure 5:
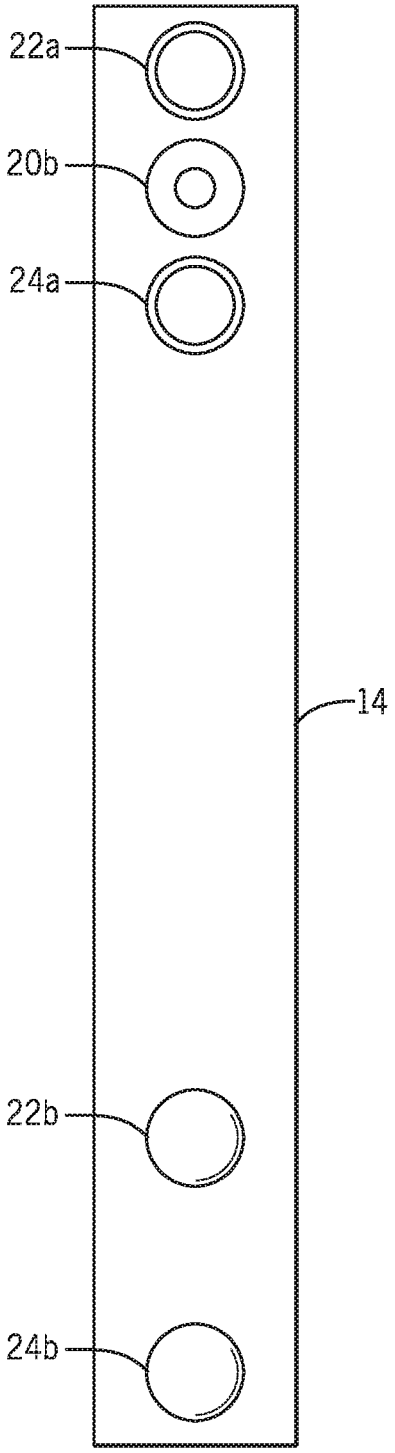
FIG. 5 is a rear elevation view of the retaining member of FIG. 4.

To facilitate an understanding of the invention, identical reference numerals have been used, when appropriate, to designate the same or similar elements that are common to the figures. Further, unless stated otherwise, the features shown in the figures are not drawn to scale, but are shown for illustrative purposes only.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Certain terminology is used in the following description for convenience only and is not limiting. The article "a" is intended to include one or more items, and where only one item is intended the term "one" or similar language is used. Additionally, to assist in the description of the present invention, words such as top, bottom, upper, lower, front, rear, inner, outer, right and left are used to describe the accompanying figures. The terminology includes the words above specifically mentioned, derivatives thereof, and words of similar import.

A first embodiment of a light unit 16 of the present invention is shown in FIGS. 2, 3 and 6-9. The light unit 16 may include a housing 17 having a power source compartment 34 open to a first end. The housing 17 may be water resistant. A power source may fit inside the power source compartment 34 of the housing 17. The power source may include at least one removable battery 32. The at least one battery 32 may be a lithium battery. A power source compartment closure 30 may enclose the power source within the power source compartment 34 of housing 17. The light unit 16 may also include a cover 26 which may enclose the power source and the power source compartment closure 30 within the housing 17. The cover 26 may removably attach to the first end of the housing 17. The cover 26 and the housing 17 could be coupled together by various means including snap fit engagement, threaded engagement or by fasteners such as screws.

Still referring to FIGS. 2, 3 and 6-9, a light 18 may attach to a second end of the housing 17 and be connected to the power source 32. The light 18 may be a light-emitting diode (LED), an infra-red beacon or the like. In certain embodiments, the light 18 may include two diodes with a push button mechanism to activate the light 18 and may allow continuous light or a flashing light. In certain embodiments, the light used may be a different color based on what may be required for the use of the present invention. In certain embodiments, the cover 26 may attach to a plate 28. In this embodiment, the plate 28 includes a first fastener secondary member 20*a*, the function of which will be described in more detail below. A pair of wings 21, 23 form a base 19 and are coupled to the plate 28. Each wing 21, 23 includes a hole 21*a*.

Figure 10:
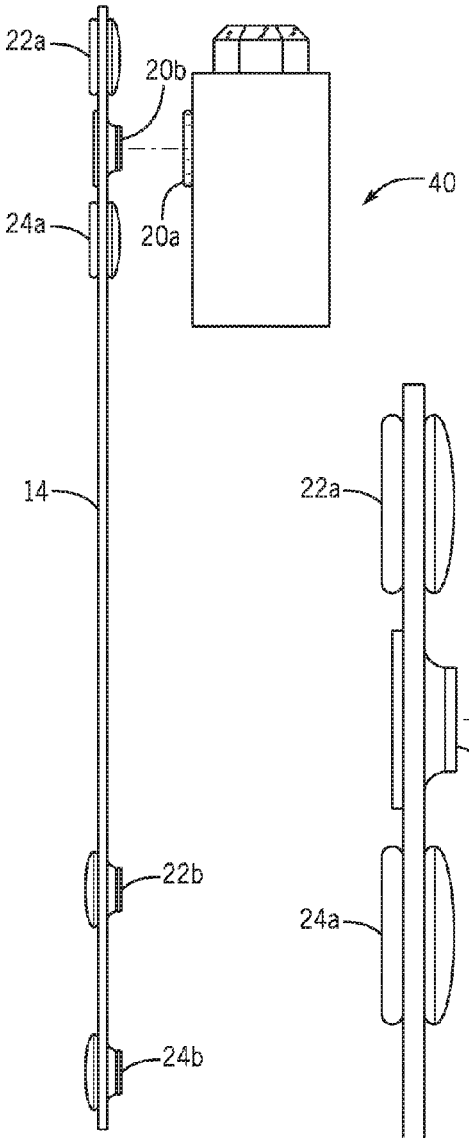
FIG. 10 is a side elevation view of a third embodiment of a lighting assembly of the present invention with a second embodiment of a light unit of the present invention detached from a retaining member.
Figure 11:
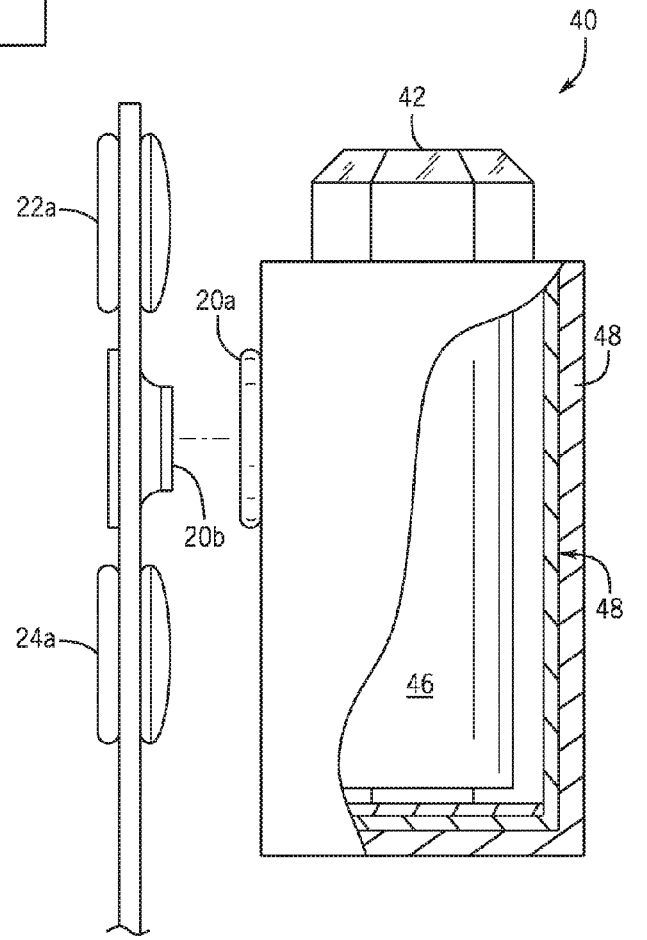
FIG. 11 is a detailed side elevation view of the lighting assembly of FIG. 10 with a partial cross-sectional view of the light unit.
Figure 12:
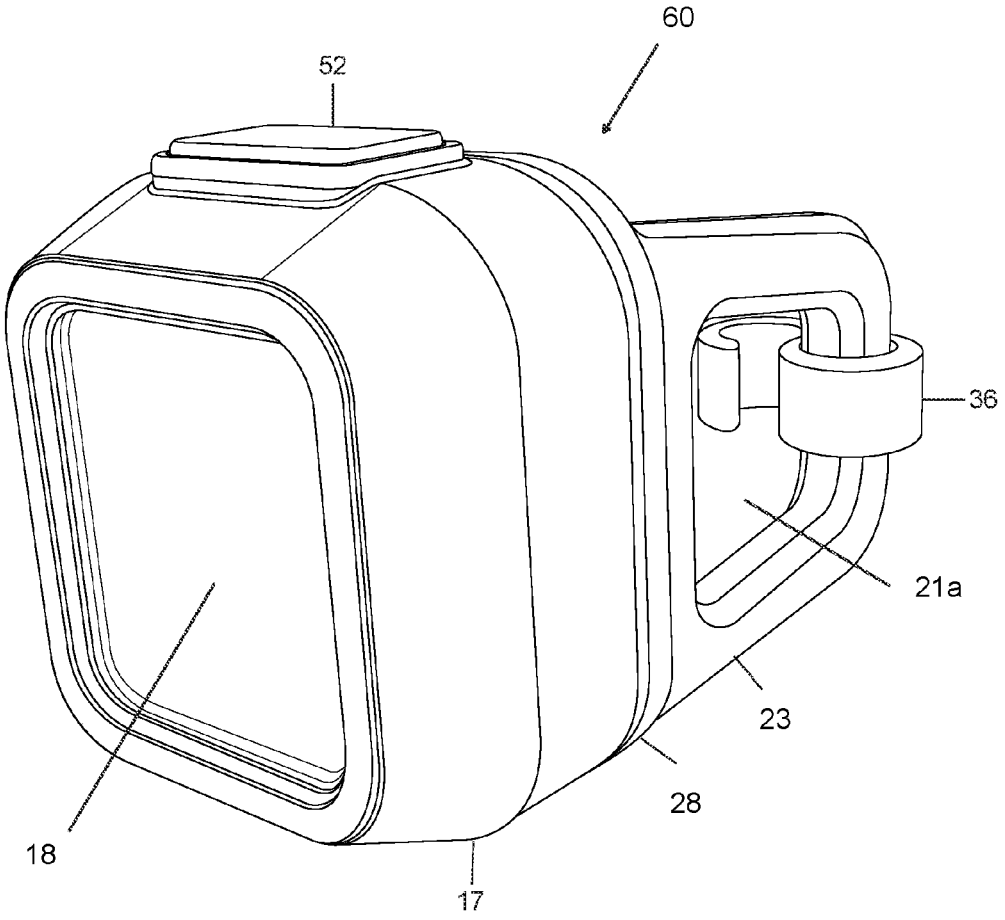
FIG. 12 is a perspective view of a third embodiment of a light unit of the present invention.
Figure 13:
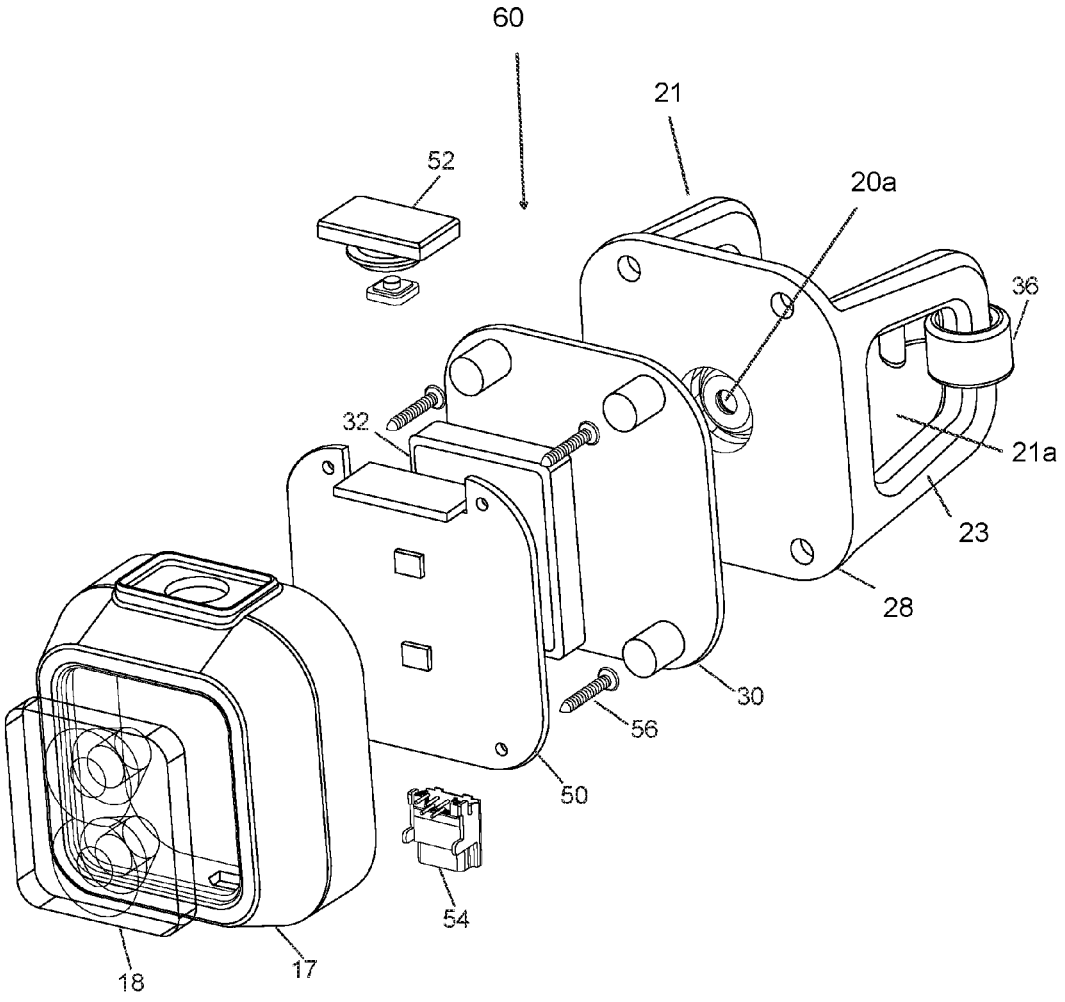
FIG. 13 is an exploded view of the light unit of FIG. 12.
Figure 14:
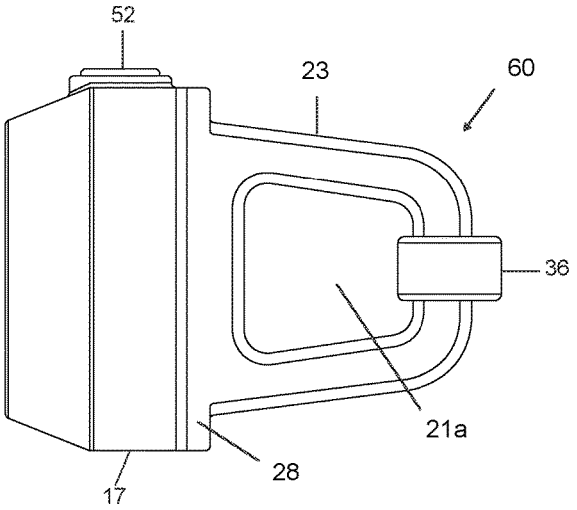
FIG. 14 is a side elevation view of the light unit of FIG. 12.
Figure 15:
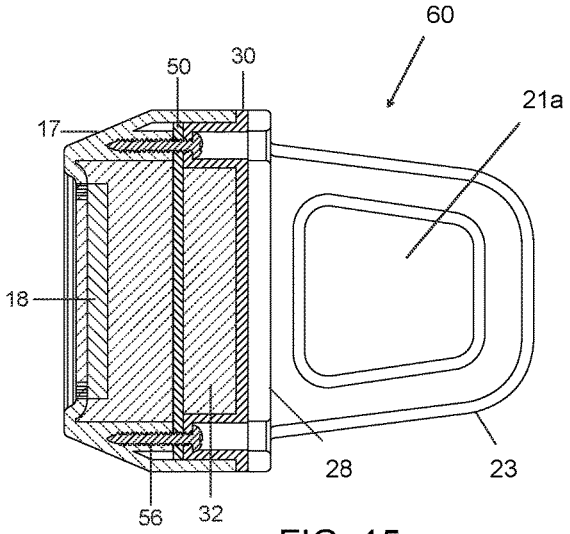
FIG. 15 is a cross-sectional view of the light unit of FIG. 12.
Figure 16:
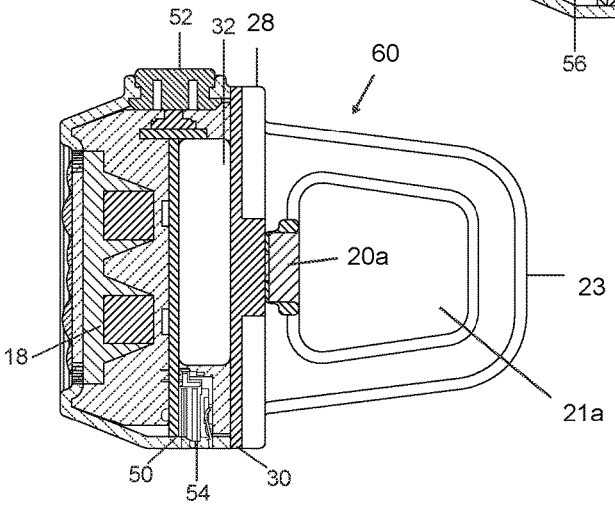
FIG. 16 is another cross-sectional view of the light unit of FIG. 12.

A second embodiment of a light unit 40 of the present invention is shown in FIGS. 10 and 11. In this embodiment, the light unit 40 is a pouch 48 having a lens 42 extending therefrom at a top end. In certain embodiments, the light 42 may include a clear lens. The pouch 48 could be used to store a light or other items. For example, the light unit of the first embodiment 16 could be stored within the pouch 48 so that is emitted through the lens 42. In other examples, other items such as keys, money, mobile device and other valuables could be stored therein. The pouch 48 may have a battery 46 enclosed therein and operably coupled to any electronics stored therein. The pouch 48 also includes a first fastener secondary member 20*a* extending therefrom for attaching to a first fastener primary member 20*b* of a retaining member 14, the function of which will be described in more detail below.

A third embodiment of a light unit 60 of the present invention is shown in FIGS. 12-16. In this embodiment, the light 18 includes at least two diodes and is operably coupled to a circuit board 50. The circuit board 50 is operably coupled to a power switch 52 in the form of a push button to activate the light 18 and may allow continuous light or a flashing light. In certain embodiments, the light used may be a different color based on what may be required for the use of the present invention and the could be selectively activated by the push button 52.

Still referring to FIGS. 12-16, the power source compartment closure 30 of the light unit 60 includes a power source 32 in the form of a rechargeable battery. The rechargeable battery is fixed to the power source compartment closure 30 and operably coupled to a universal serial bus (USB) port 52 for recharging the battery.

In other embodiments, the light unit 60 includes a wireless communications device. The wireless communications device may be a transmitter only, a receiver only, or a transmitter and receiver. The wireless communications device may be a long-range mobile communications device, a short-range wireless communications device, or the like which is capable of transmitting GPS coordinates or receiving instructions. Furthermore, various other functions could be coupled with the communications device including audio and/or visual.

Referring again to FIGS. 12-16, the plate 28 includes the first fastener secondary member 20*a* at a central portion thereof. A pair of wings 21, 23 are formed integrally to the plate 28 and extends therefrom. Each wing 21, 23 includes holes 21*a*. The housing 17, circuit hoard 50, power source compartment closure 30 and plate 28 are held together by fasteners such as screws 56. The light unit 60 could take on other shapes such as a round cross-section. The plate 28 and the housing 17 could also be coupled together by other means including snap fit engagement, threaded engagement or by fasteners such as screws.

Referring to FIGS. 1-5 and 10-11, a first embodiment of a retaining member 14 of the present invention is shown. In this embodiment, the retaining member 14 is a strap or belt keeper. The belt keeper 14 includes a first faster primary member 20*b* for attaching the first fastener secondary member 20*a* of the light units 16, 40, 60 described above. In certain embodiments, the strap 14 may also have a second fastener 22 and a third fastener 24. The second fastener 22 may have a second fastener secondary member 22*a* and a second fastener primary member 22*b*. The third fastener 24 may have a third fastener secondary member 24*a* and a third fastener may member 24*b*. In certain embodiments, the second fastener 22 and the third fastener 24 may be used in order to further secure the strap 14 to the object as shown for example in FIG. 1. That is, the strap 14 is inserted through each hole 21*a* of the wings 21, 23; the strap 14 is secured around the belt 12; each end of the strap 14 is overlapped with each other; and each fastener 21, 22, 24 is engaged and secured.

In certain embodiments, the fasteners may have a snap socket and stud, a hook and latch system or the like. The strap 14 may be removably attached to a belt 12 such as a utility belt, a pants belt and the like. The strap 14 may also be securely attached to other objects.

Referring to FIGS. 9 and 12-14, in certain embodiments, the first wing 21 and the second wing 23 may be removably secured to an object by an alternative retaining member or hook 36. In certain embodiments, the hook 36 may have an S-shape.

Referring to FIG. 8, yet another alternative retaining member is shown. In this embodiment, the light unit 16, 60 may be attached directly to the hand of a user. In one application, a gun user could insert a finger of the support hand through the holes 21 of the wings 21, 23 to use the light as a guide while aiming the gun. The light unit 16, 60 could be positioned such that the power switch 52 is at an upper portion of the light unit 16, 60 so that it could be activated with the thumb of the user's support hand while holding the gun.

A method of using the portable light assembly may include the user illuminating themselves to avoid hazards. Examples of individuals that may use the present invention may include police officers conducting motor vehicle stops, children wearing the present device in busy malls, riding their bicycles; crossing guards may bring more attention to themselves to avoid getting hit by traffic. Utility workers may wear the present invention be seen to avoid getting injured on a work site. Parents may place the present invention on strollers to illuminate them to avoid getting hit by traffic. Firefighters may place them on the rear of the air packs so they can be seen in a smoky fire. Rescue workers may be safer helping others at accident scenes so drivers may see them and their equipment because the light flashes and brings attention to their presence. People may place these lights on pets and their own belts so traffic and other individuals may see them easily. Nursing homes may place the portable, lighting assembly of elderly patients to keep better track of their location. Hikers may wear the present invention to be located when they are lost or to mark a trail. Sanitation workers may wear the present invention to avoid being struck in traffic and construction and paving workers may mark themselves to avoid hazards like traffic, heavy equipment use, and they may also be used to mark dangerous sites.

The portable lighting assembly may be snapped onto objects to display them and bring additional attention to them. People may wear the present invention at clubs and they may wear the present invention if they break down on the side of the road. Tree crews may attach the present invention to trees that need to be taken down.

The portable lighting assembly may attach to anything someone wants to draw attention to in their lives. An example may be to include the infrared beacon alerting others to the user's location in low light or complete darkness. In certain embodiments, this may include emitting a light only detected by infra-red vision so that specialized weapons and tactical teams may be alerted of the location while remaining undetected by an adversary. Another situation may be a firefighter alerting his location in complete darkness which may include a smoke filled environment.

In certain embodiments, the portable lighting assembly includes a GPS receiver and wireless communications device. The wireless communications device can transmit the portable lighting assembly's GPS coordinates to provide an additional method of locating the portable lighting assembly. The transmission can be always on or turned on manually and can operate independent of the light. Covert operators can use the present invention to track movements and mark locations with the light off so as to conceal activity. The wireless communications device may be a short-range radio or long-range mobile communications device. The wireless communications device may receive instructions to manipulate the light remotely. A portable lighting device with the light off can be located using the wireless communication device to turn the light on.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A portable lighting assembly comprising a light unit, the light unit comprising:

a housing having a front end and an opposing rear end, and an interior space therebetween, the housing disposed at a front end of the light unit;

a light attached to the housing;

a power source operably coupled to the light and disposed within the housing interior space;

a plate disposed at a rear end of the light unit, the plate coupled to the rear end of the housing to form an enclosure; and a first member of a first fastener disposed on the plate.

2. The portable lighting assembly of claim 1, further comprising a retaining member for securing the light unit.

3. The portable lighting assembly of claim 2, wherein the retaining member comprises a second member of the first fastener such that the first and second members of the first fastener are detachably coupled.

4. The portable lighting assembly of claim 3, wherein the retaining member is a strap, the strap comprising a second fastener having a first member spaced apart from a second member such that the said first and second members are engaged and the strap is secured.

5. A portable lighting assembly comprising a light unit, the light unit comprising:

a housing having a front end and an opposing rear end, and an interior space therebetween, the housing disposed at a front end of the light unit;

a light attached to the housing;

a power source operably coupled to the light and disposed within the housing interior space;

a plate disposed at a rear end of the light unit, the plate coupled to the rear end of the housing to form am enclosure, and at least one wing extending from the rear end of the light unit.

6. The portable lighting assembly of claim 5, further comprising a retaining member for securing the light unit.

7. The portable lighting assembly of claim 6, wherein the retaining member is a hook, the hook being coupled to the at least one wing and secured to an object.

8. The portable lighting assembly of claim 6, wherein the retaining member is a strap, the strap being attached to the at least one wing and secured to an object.

9. A portable lighting assembly comprising:

a housing comprising a power source compartment open to a first end, wherein a power source is enclosed by a power source compartment closure;

a cover enclosing the power source and power source compartment closure, wherein the cover removably attaches to the first end of the housing;

a light attached to a second end of the housing, wherein the light connects to the power source; and at least one wing such that a retaining member is connected thereto and secured to an object.

10. The portable lighting assembly of claim 9, wherein the power source is at least one battery.

11. A portable lighting assembly comprising:

a housing comprising a power source compartment open to a first end, wherein a power source is enclosed by a power source compartment closure;

a cover enclosing the power source and power source compartment closure, wherein the cover removably attaches to the first end of the housing;

a light attached to a second end of the housing, wherein the light connects to the power source; and a first member of a first fastener for securing to a second member of a second fastener of a retaining member;

wherein the retaining member is a strap.

12. The portable lighting assembly of claim 11, wherein the power source is at least one battery.

13. The portable lighting assembly of claim 12, wherein the at least one battery is rechargeable.

14. A portable lighting assembly comprising:

a housing comprising a power source compartment open to a first end, wherein a power source is enclosed by a power source compartment closure;

a cover enclosing the power source and power source compartment closure, wherein the cover removably attaches to the first end of the housing;

a light attached to a second end of the housing wherein the light connects to the power source; and a wireless communications device.

15. The portable lighting assembly of claim 14, further comprising a GPS receiver for communicating through the wireless communications device.

16. The portable lighting assembly of claim 14, wherein the power source is at least one battery.

17. The portable lighting assembly of claim 16, wherein the at least one battery is rechargeable.

18. A portable lighting assembly comprising:

a housing comprising a power source compartment open to a first end, wherein a power source is enclosed by a source compartment closure;

a cover enclosing the power source and power source compartment closure, wherein the cover removably attaches to the first end of the housing, and a light attached to a second end of the housing, wherein the light connects to the power source;

wherein the light is visible and invisible and selected from a group consisting of incandescent bulbs, fluorescent, high-intensity discharge, light emitting diodes and infrared.

19. The portable lighting assembly of claim 10, wherein the at least one battery is rechargeable.

20. The portable lighting assembly of claim 18, wherein the power source is at least one battery.

* * * * *